United States Patent [19]

Liou

[11] 4,359,788

[45] Nov. 23, 1982

[54] DISC TYPE KITCHEN SINK DRAIN VALVE

[76] Inventor: Shu-Lien Liou, 2 Fl., No. 33, Lane 52, Szu Wei Rd., Taipei, Taiwan

[21] Appl. No.: 177,834

[22] Filed: Aug. 13, 1980

[51] Int. Cl.[3] ..... A47K 1/14; E03C 1/26

[52] U.S. Cl. ..... 4/287; 4/295; 4/286

[58] Field of Search ..... 4/286, 287, 290, 295

[56] References Cited

U.S. PATENT DOCUMENTS

| | | | |
|---|---|---|---|
| 2,090,299 | 8/1937 | Kuhnle | 4/287 |
| 2,450,392 | 9/1948 | Donahue | 4/287 |
| 2,450,393 | 9/1948 | Donahue | 4/287 |
| 2,464,018 | 3/1949 | Bloch | 4/287 |
| 2,544,498 | 3/1951 | Hiertz | 4/287 |
| 2,569,615 | 10/1951 | Link | 4/287 |
| 3,588,928 | 6/1971 | Hiertz | 4/287 |
| 3,777,320 | 12/1973 | Politz | 4/287 |
| 3,849,809 | 11/1974 | Morris et al. | 4/295 |
| 4,103,372 | 8/1978 | Cuschera | 4/287 |
| 4,188,676 | 2/1980 | Tolnai et al. | 4/295 |
| 4,232,407 | 11/1980 | Williams | 4/287 |

*Primary Examiner*—Henry K. Artis

*Attorney, Agent, or Firm*—Tak Ki. Sung

[57] ABSTRACT

This invention discloses a disc type kitchen sink drain valve mounted on a strainer that is placed in the well provided in the bottom of a kitchen sink, the drain valve comprising a sleeve fixed vertically and substantially at the center of the bottom plate of the strainer, a valve member having a valve stem slidably inserted in the sleeve, and fixed at the lower end of the valve stem an elastic valve body of disc type capable of moving up and down with the valve stem to open and close the drain port provided at the bottom of the well of the kitchen sink by uncovering and covering the drain port.

4 Claims, 17 Drawing Figures

DISC TYPE KITCHEN SINK DRAIN VALVE

BACKGROUND OF THE INVENTION

1. Field of the Invention

This invention relates to kitchen sink drain valves, more particularly to a disc type kitchen sink drain valve mounted on a strainer that is placed in the well provided in the bottom of a kitchen sink, to open and close the drain port provided at the bottom of the well of the kitchen sink.

2. Brief Description of Prior Art

Kitchen sinks are usually provided with a well for collecting the waste water in the sink to be drained through a drain port provided therein. The drain port is usually provided with a drain valve which is mounted on a strainer placed in the well. A conventional drain valve comprises a valve stem slidably or fixedly mounted on the strainer, and a valve body fixed at the lower end of the valve stem, the valve body having a tapered peripheral surface capable of fitting in the drain port to close the drain port when the valve body is lowered, and also capable of moving upwardly to open the drain port.

In the above-mentioned conventional drain valve the closing and opening of the drain port is performed by the engagement and disengagement of the tapered peripheralsurface of the valve body with and from the edge of the drain port. Therefore, the edge of the drain port has to be properly finished or formed to conform with the contour of the tapered peripheral surface of the valve body to assure watertight closure when the valve body is lowered to fit in the drain port to close the drain port. However, if the taper or the inclination of the peripheral surface of the valve body is made small in order to produce greater wedge effect for a tighter fit, the thickness or height of the valve body has to be substantially great and the valve body has to be raised a substantially long distance to give sufficient opening between the valve body and the edge of the drain port for draining the water, which requires a larger space between the bottom of the strainer and the bottom of the well of the sink. Under actual circumstances the height or thickness of the valve body of conventional drain valves is quite limited and thus the taper or the inclination of the peripheral surface is relatively great. Because of the greater taper of the peripheral surface, the valve body comes in contact with the upper edge of the drain port in the form of a line instead of a surface, and thus there is less wedge effect and therefore less watertightness.

Moreover, conventional kitchen drain valves are not provided with proper holding means for holding the valve stem or valve body in an open position against the turbulence of the draining water when draining. Therefore, the valve body may be pulled down by the turbulence of the draining water to close the drain port during the draining process.

In a separate application by the same inventor, Ser. No. 173,610 filed on July 30, 1980 the inventor has proposed improved constructions of kitchen sink drain valve having a resilient member for frictionally holding the valve stem, and a disc type valve body to be used in conjunction with the valve stem provided with the resilient member. In this invention, the inventor proposes the use of an elastic disc type drain valve body independent from the valve stem constructions proposed in the aforesaid application.

SUMMARY OF THE INVENTION

This invention relates to a disc type kitchen sink drain valve. The disc type kitchen sink drain valve of this invention comprises a sleeve vertically mounted at substantially the center of the bottom plate of the strainer placed in the well provided at the bottom of the kitchen sink, a valve member having an elastic, disc type valve body fixed at the lower end of the valve stem which is slidably inserted in the sleeve, the disc type valve body having an outside diameter larger than the inside diameter of the drain port and being adapted to cover and uncover the drain port when the valve stem is moved downwards and upwards, the valve stem being provided with keys suitably formed at the middle portion of the stem to slide along the longitudinal slots in the sleeve, the keys being adapted to move in the recesses formed along the inner periphery at the upper end of the longitudinal slots when the valve stem is raised and rotated a certain angle, the recesses each having a lower edge adapted to positively hold the valve stem in a raised (open) position. The valve body, when lowered, abuts the surface of the bottom of the well around the upper edge of the drain port to form a surface contact and tightly covers the drain port with the weight of water in the sink acting on its backside without a need of force to be otherwise applied.

Therefore, it is the main object of this invention to provide a disc type kitchen sink drain valve that closes the drain port, when lowered, in a surface contact with the bottom of the well around the upper edge of the drain port.

It is another object of this invention to provide a disc type kitchen sink drain valve in which less distance of lift is required to give sufficient opening of the drain port when the valve body is raised.

It is still another object of this invention to provide a disc type kitchen drain valve with the valve stem which is positively held in an open position to prevent the valve from dropping down during the draining of the water from the sink.

Figure 1:
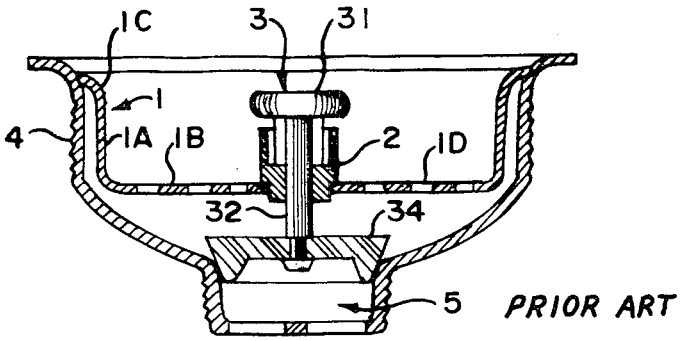
FIGS. 1 and 2 are longitudinal cross sectional views of conventional drain valves for kitchen sinks, showing their closed position.
Figure 2:
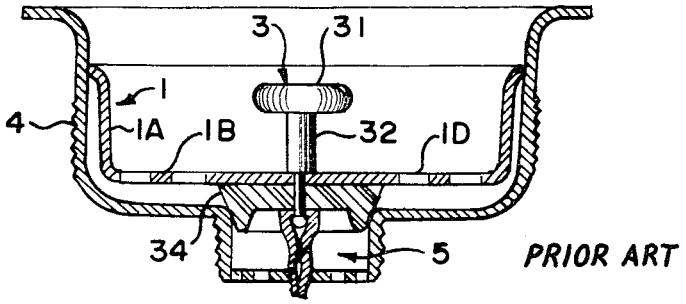

For comparison purposes two conventional drain valves for kitchen sinks are shown in FIGS. 1 and 2. In the drawings, 4 is the well, 1 is the strainer, 2 is the sleeve, 3 is the valve member, 32 is the valve stem, 34 is the valve body, 5 is the drain port.

Figure 3:
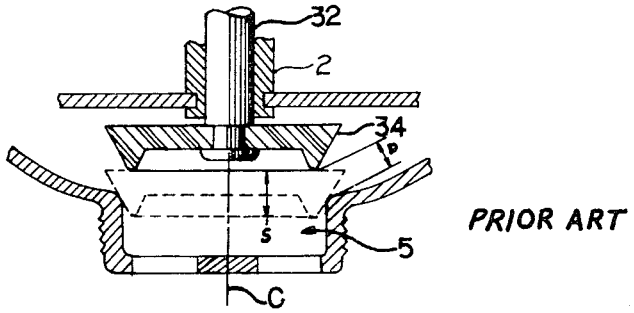
FIG. 3 is a fragmental, longitudinal, cross sectional view of a conventional drain valve for a kitchen sink in an open position, showing the distance the valve body is raised from its closed position.

FIG. 3 shows a conventional drain valve for kitchen sinks in an open position. The valve body in its closed position is shown in dotted lines. S indicates the distance through which the valve body is raised to give an opening of the drain port indicated by D which is evidently substantially smaller than S.

Figure 4:
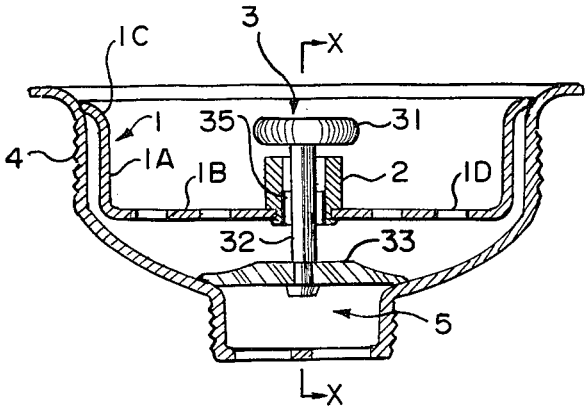
FIG. 4 is a longitudinal, cross sectional view of an embodiment of the disc type kitchen sink drain valve of this invention, in its closed position.

FIG. 4 shows an embodiment of this invention. As shown in the drawing, the drain valve of this invention comprises a cylindrical strainer 1 to be placed in the well 4 of a kitchen sink, the strainer 1 having a flared upper flange 1C adapted to be supported by the upper edge of the well to leave a suitable space between the bottom of the strainer and the bottom of the well, the strainer 1 also having a bottom plate 1B provided with a plurality of holes 1D through which the water in the sink may flow to enter the drain port provided in the bottom of the well, a sleeve 2 vertically fixedly mounted substantially in the center portion of the bottom plate of the strainer 1, a valve member 3 having a valve stem 32 slidably inserted in the sleeve, a knob 31 integrally formed at the upper end of the valve stem 32, and a valve body 33 fixed at the lower end of the valve stem 32, the valve body 33 being made of suitable elastic material such as rubber in disc shape having an outside diameter larger than the inside diameter of the drain port 5. The valve body 33 is preferably so formed that its thickness is gradually reduced from the central portion toward its outer periphery in order to provide more elasticity at the periphery than at the central portion. The valve stem 32 has a suitable length with respect to the sleeve 2 so that the knob 31 formed at the upper end of the valve stem 32 will not come in contact with the upper end of the sleeve 2 when the valve member 3 is lowered to cover the drain port 5 with the valve body 33.

When the valve member 3 is lowered to cover the drain port 5 with the valve body 33, the surface of the bottom side of the valve body abuts the surface of the bottom of the well around the drain port. As soon as water is supplied into the sink and flows in the well, the weight of the water acts on the back side of the valve body and makes the contact a watertight engagement without the need of additional force to be otherwise applied. The elasticity of the valve body renders close adhesion of the valve body to the surface of the bottom of the well around the drain port to assure the watertightness of the contact engagement.

Figure 5:
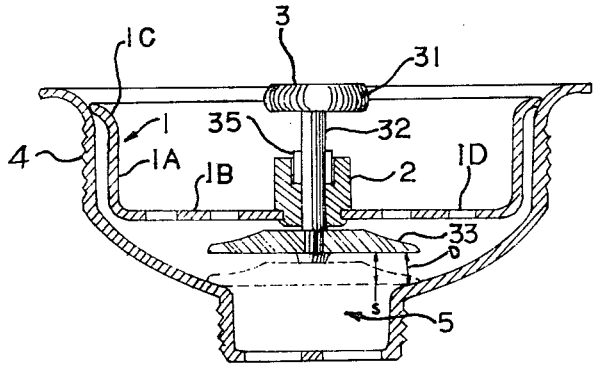
FIG. 5 is a longitudinal, cross sectional view of the embodiment as shown in FIG. 4, in its open position, taken along the line X—X as shown in FIG. 4.

FIG. 5 shows the drain valve of FIG. 4 in an open position, in which the valve stem is positively held in position as will be described later. In the drawing, S indicates the distance the valve body is raised from the closed position to give an opening indicated by D. It is apparent from the drawing that D nearly equals S, that is to say, the drain valve of this invention requires less distance of lift to give the same opening as a conventional drain valve does as shown in FIG. 3.

Figure 6:
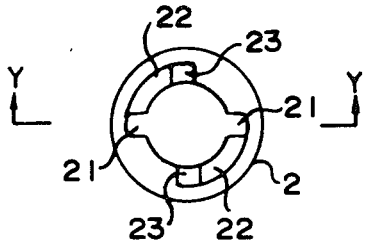
FIG. 6 is a top view of the sleeve of the drain valve as shown in FIG.4, with the valve stem removed.
Figure 7:
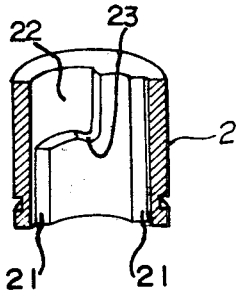
FIG. 7 is a perspective, longitudinal, cross sectional view of the sleeve of the drain valve as shown in FIG. 4, with the valve stem removed, taken along the line Y—Y as shown in FIG. 6.
Figure 8:
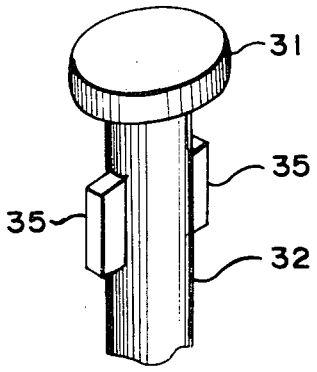
FIG. 8 is an oblique, perspective view of the upper portion of the valve stem of the drain valve as shown in FIG. 4.

In a suitable place on the valve stem 32 a pair of keys 35 are provided as shown in FIG. 8. The keys 35 are disposed symmetrically opposite to each other on the periphery of the valve stem 32. The sleeve 2 is provided with a pair of slots 21 disposed longitudinally in the inner surface of the sleeve symmetrically opposite to each other for slidably receiving the keys 35 therein. At the upper end of each slot a recess is provided along the inner peripheral surface of the sleeve 2 in a clockwise direction around the center axis of the sleeve at an angle of approximately 90 degrees, as shown in FIGS. 6 and 7. At the end portion of the lower edge of the recess 22 is provided a slightly concave portion 23.

When the valve stem 32 is inserted in the sleeve 2, the keys 35 are aligned with and slidably inserted in the slots 21. The keys 35 are so disposed that when the valve stem 32 is pulled all the way up till the upper side of the valve body abuts the lower end of the sleeve 2 the lower edge of the keys 35 are slightly above the lower edge of the recess 22. By rotating the valve stem 35 clockwise while it is in the uppermost position, for approximately 90 degrees to move the keys 35 in the recesses 22 and then release the valve stem 32, the keys 35 will seat on concave portion 23 and thus the valve stem 32 is positively held in an open position. By rotating the valve stem 32 counterclockwise for approximately 90 degrees till the keys 35 hit the left side edges 24 of the recesses 22, which are flush with the left sides of the slots 21, and releasing it, then the valve stem 32 can be dropped or lowered to close the drain port with valve body. The concave portion 23 is so shallow that the keys are disengaged without adding an effort to raise the valve stem 32 when the valve stem 32 is rotated counterclockwise.

It is to be noted that the valve stem 32 has sufficient length that the lower part of the knob at the upper end of the valve stem 32 is still high above the upper end of the sleeve 2 when the valve body reaches the bottom of the well, so that the valve body effectively comes in contact with the surface of the bottom around the upper edge of the drain port with the weight of water in the sink acting on its upper surface.

Figure 9:
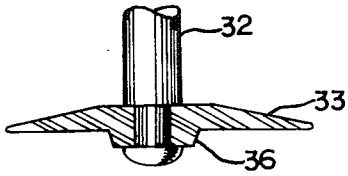
FIG. 9 is a fragmental, cross sectional view of the first modified construction of the disc type kitchen sink drain valve of this invention, showing a modified valve body.
Figure 10:
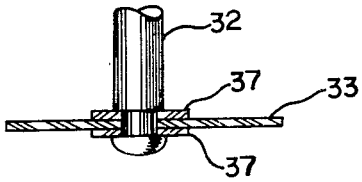
FIG. 10 is a fragmental, cross sectional view of the second modified construction of the disc type kitchen sink drain valve of this invention, showing a disc type valve body with uniform thickness.
Figure 11:
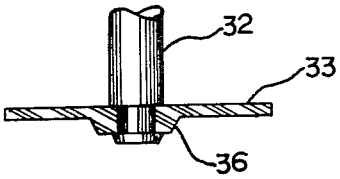
FIG. 11 is fragmental, cross sectional view of the disc type kitchen sink drain valve of this invention, showing a disc type valve body with uniform thickness reinforced with a boss on one side.

Although a valve body having its thickness gradually reduced from the central portion towards the outer periphery and its generally flat bottom surface is illustrated, the valve body can be suitably reinforced with a boss 36 on either side as shown in FIG. 9. It is also to be understood that a plain circular disc of uniform thickness can be used with proper means of reinforcement such as washers 37 or boss 36 as shown in FIGS. 10 and 11.

Figure 12:
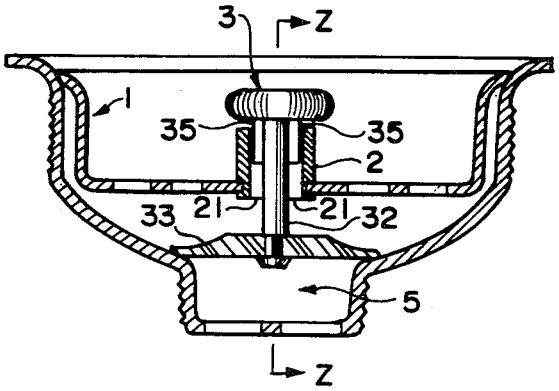
FIG. 12 is a longitudinal, cross sectional view of another embodiment of the disc type kitchen sink drain valve of this invention, in its closed position.
Figure 13:
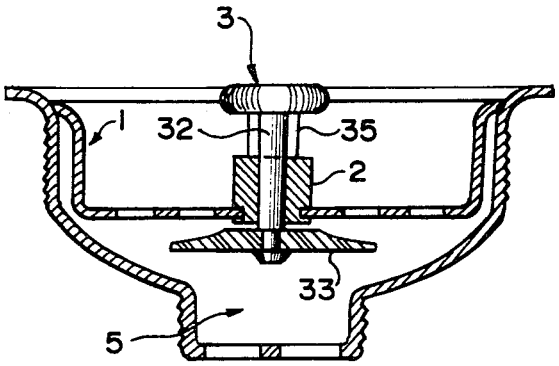
FIG. 13 is a longitudinal, cross sectional view of the embodiment as shown in FIG. 12, in its open position, taken along the line Z—Z as shown in FIG. 12.

FIGS. 12 and 13 show another embodiment of this invention. In this embodiment, the construction of the entire drain valve is similar to that shown in FIG. 4 except that the valve stem 32 is provided with a pair of key means 35 at the upper end portion of the valve stem, and the sleeve 2 is provided with a pair of longitudinal slots 22 in the inner wall thereof to slidably receive the key means 35 when the valve stem 32 is inserted in the sleeve 2 and lowered to close the drain port 5 with the valve body 33. The key means 35 are so arranged that the lower end of the key means move slightly above the upper end of the sleeve 2 to clear the slots 22 when the valve stem 32 is raised all the way up. With the valve stem 32 raised to its uppermost position and the keys 35 disengaged from the slots 21, rotate the valve stem 32 is rotated a certain angle then valve stem 32 can be released to let the keys 35 lie on the upper edge of the sleeve 2. Thus the valve body 33 can be kept in an open position, as shown in FIG. 13.

Figure 14:
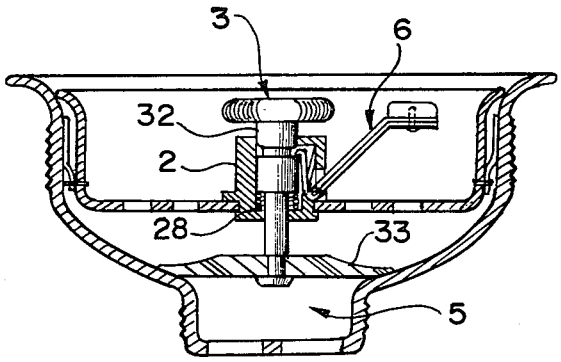
FIG. 14 is a longitudinal, cross sectional view of a third embodiment of this invention, in its closed position.
Figure 15:
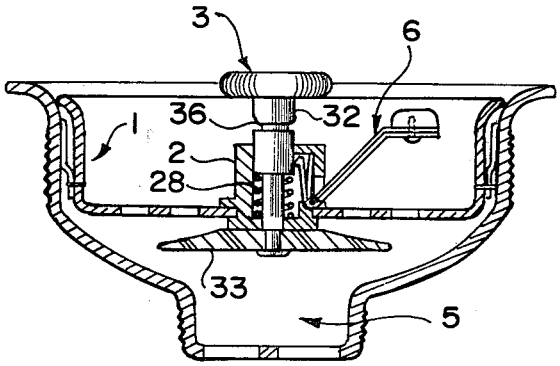
FIG. 15 is a longitudinal, cross sectional view of the third embodiment of this invention as shown in FIG. 14, in its open position.
Figure 16:
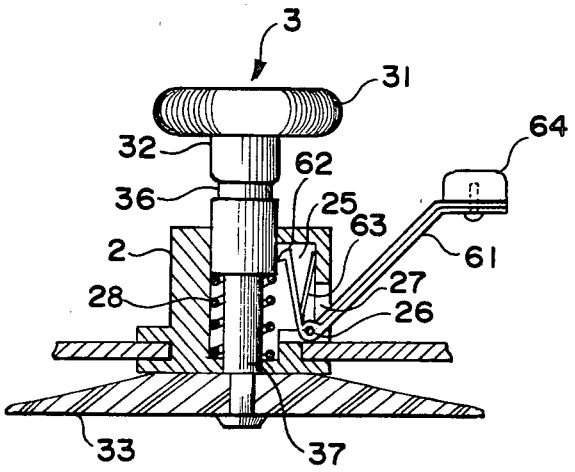
FIG. 16 is an enlarged, cross sectional view of the main portion of the third embodiment of this invention as shown in FIG. 14.
Figure 17:
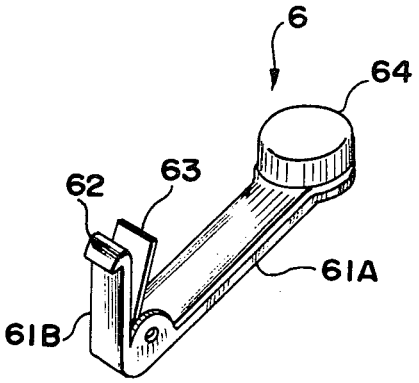
FIG. 17 is an oblique, perspective view of the latch device used in the third embodiment of this invention.

FIGS. 14 and 15 show a third embodiment of this invention, whose detail is shown in FIGS. 16 and 17.

As shown in the drawings, the third embodiment of this invention is provided with a latch device 6 pivotally mounted on the sleeve 2 with a hinge pin 26, said latch device 6 having a latch lever 61 generally formed into a L-shape comprising an outer leg 61A and inner leg 61B, the inner leg 61B being provided with a hook-like latch head 62 at its free end, and the outer leg 61A being provided with a knob 64 at its free end. The latch device 6 is further provided with a spring piece 63 in V shape having one leg fixed onto the upper side of the outer leg 61A of the latch lever 61, and the another leg extending freely from the heel portion of the latch lever upwardly and outwardly.

The sleeve 2 is provided with a compartment 25 in the inner wall and a through hole 27 as shown in FIG. 16. The latch device 6 as described above is pivotally mounted with a hinge pin 26 to the sleeve 2 with the outer leg 61A extending outwardly and upwardly through the through hole 27, and with the inner leg 61B accommodated in the compartment 25. The free leg of the spring piece 63 is arranged to abut the wall of the compartment 25 so that a resilient force is produced and acts on the inner leg 61B of the latch device to keep the latch head 62 in pressured contact with the valve stem 32.

The valve stem 32 is provided with an annular groove 36 at a suitable distance from the upper end so that when the valve stem 32 is pushed down to close the drain port the groove 36 is engaged with the latch head 62 and thereby the valve stem 32 is held in closed position.

The valve stem 32 is further provided with a shank portion 37 having a smaller diameter, over which a coil spring 28 is installed. The lower end portion of the sleeve 2 is provided with a flange on which the spring 28 is retained, and thus the valve member 3 is always urged upwardly by the spring 28.

In the third embodiment as described above, the valve member can be raised by simply depressing the knob 64.

By depressing the knob 64 the inner leg 61B of the latch lever 61 sways outwardly with respect to the hinge pin 26 to disengage the latch head 62 from the groove 36 of the valve stem 32. As a result the valve member 3 is released from being held by the latch device 6 and raised by the force of the spring 28, thus opening the drain port, till the valve body 33 abuts the lower end of the sleeve 2 and is stopped thereby.

Because the latch head 62 is always in pressured contact with the valve stem, the latch head will automatically engage with the groove 36, or "latch" the valve member 3, when the valve member 3 is pushed down to close the drain port with the valve body 33, and thereby the valve body is kept in closed position.

It is to be understood that the spring piece 63 can be in any forms other than V shape, for example, a leaf spring with one end fixed to the lower end of the inner leg 61B and other end abutting on the wall of the compartment 25, or a coil spring inserted in between the backside of the latch head 62 and the wall of the compartment 25, will equally serve the purpose.

While there have been shown and described a preferred embodiment and its modified constructions of the present invention, it will be understood that the invention may be further modified otherwise than as herein specifically illustrated and that certain changes can be made without departing from the idea or principles of this invention within the scope of the appended claims.

I claim:

1. A drain valve for opening and closing the drain port of a kitchen sink having a well provided in the bottom thereof, said drain port being located substantially at the center portion of the bottom of said well, comprising a strainer coaxially placed in the well, said strainer having a bottom plate with a plurality of holes therein and disposed substantially above the bottom of said well, a sleeve vertically fixed substantially at the center portion of said bottom plate of said strainer, a valve member having a valve stem slidably inserted in said sleeve and a valve body fixed to the lower end of said valve stem, said valve body being made of an elastic material in circular disc shape having an outside diameter larger than the inside diameter of said drain port so that the bottom surface of said valve body is capable of abutting the surface of said well around said drain port when said valve member is lowered for closing said drain port, said valve body being adapted to cover and uncover said drain port when the valve stem is lowered and raised, respectively, said valve stem being provided with key means slidably received in a longitudinal slot formed on the inner wall of said sleeve when said valve member is lowered to cover said drain port with said valve body, said sleeve being provided with a support means for supporting said key means when said valve stem is raised to an uppermost position to open said drain port and then rotated.

2. A drain valve as recited in claim 1, wherein said supporting means is a lower edge of a recess provided at the upper end of said longitudinal slot, said recess extending transversely to the longitudinal axis of said sleeve and adapted to accommodate said key means when said valve stem is raised to the uppermost position and then rotated.

3. A drain valve as recited in claim 1, wherein said support means is an upper end of said sleeve and said key means is so disposed that when said valve stem is raised to its uppermost position the lower end of said key means is slightly above said upper end of the sleeve.

4. A drain valve for opening and closing the drain port of a kitchen sink having a well provided in the bottom thereof, said drain port being located substantially at the center portion of the bottom of said well, comprising a strainer coaxially placed in the well, said strainer having a bottom plate with a plurality of holes therein and disposed substantially above the bottom of said well, a sleeve vertically fixed substantially at the center portion of said bottom plate of said strainer, a valve member having a valve stem slidably inserted in said sleeve and a valve body fixed to the lower end of said valve stem, said valve body being made of an elastic material in circular disc shape having an outside diameter larger than the inside diameter of said drain port so that the bottom surface of said valve body is capable of abutting the surface of said well around said drain port when said valve member is lowered for closing said drain port, said valve body being adapted to cover and uncover said drain port when the valve stem is lowered and raised, respectively, said sleeve being provided with a compartment in the inner wall thereof and a hole through the wall of said compartment, and a latch device pivotally mounted on said sleeve, said latch device having a latch lever with one end being provided with a hook-like latch head and accommodated in said compartment, and the other end provided with a knob and extending through said hole outwardly, said latch device further having a spring urging said latch head inwardly to keep said latch head in pressured contact with said valve stem, said valve stem being provided with an annular groove capable of engaging said latch head when said valve member is in the closed position, and a spring constantly urging the valve member upwardly.

* * * * *